US007036347B2

(12) United States Patent
Boegli

(10) Patent No.: US 7,036,347 B2
(45) Date of Patent: May 2, 2006

(54) DEVICE FOR EMBOSSING AND/OR SATIN-FINISHING A FLAT MATERIAL

(75) Inventor: Charles Boegli, Marin-Epagnier (CH)

(73) Assignee: Boegli-Gravures SA, Marin-Epagnier (CH)

( * ) Notice: Subject to any disclaimer, the term of this patent is extended or adjusted under 35 U.S.C. 154(b) by 241 days.

(21) Appl. No.: 10/398,900

(22) PCT Filed: Oct. 3, 2001

(86) PCT No.: PCT/CH01/00594

§ 371 (c)(1),
(2), (4) Date: Apr. 11, 2003

(87) PCT Pub. No.: WO02/30661

PCT Pub. Date: Apr. 18, 2002

(65) Prior Publication Data

US 2004/0011107 A1 Jan. 22, 2004

(30) Foreign Application Priority Data

Oct. 13, 2000 (CH) ..... 2012/00

(51) Int. Cl.
*B21D 13/10* (2006.01)

(52) U.S. Cl. ..... 72/196; 428/187

(58) Field of Classification Search ..... 72/196; 40/616; 264/280, 282
See application file for complete search history.

(56) References Cited

U.S. PATENT DOCUMENTS

| | | | | |
|---|---|---|---|---|
| 3,335,592 | A * | 8/1967 | Woodling | 72/196 |
| 3,673,839 | A * | 7/1972 | Nielsen et al. | 72/196 |
| 5,007,271 | A | 4/1991 | Boegli | |
| 5,582,103 | A | 12/1996 | Tanaka et al. | |

FOREIGN PATENT DOCUMENTS

| | | |
|---|---|---|
| EP | 0 194 042 A | 9/1986 |
| EP | 0 925 911 A | 6/1999 |
| EP | 0 939 037 A | 9/1999 |

* cited by examiner

*Primary Examiner*—Lowell A. Larson
(74) *Attorney, Agent, or Firm*—Foley & Lardner LLP

(57) ABSTRACT

A device for satinizing and simultaneously embossing flat materials that includes at least two embossing rolls. One roll is connected to a driving system. The rolls are adapted to be driven individually or in common and are adapted to be resiliently applied against each other. Pyramidal or conical teeth of the rolls have flattened tips. The teeth of at least one roll are shaped so as to produce embossed signs in corresponding locations of the passing flat material so that the appearance of the embossed signs changes according to at least one of a viewing angle of the observer, a kind, and the position of the lighting source.

13 Claims, 2 Drawing Sheets

DEVICE FOR EMBOSSING AND/OR SATIN-FINISHING A FLAT MATERIAL

BACKGROUND OF THE INVENTION

The present invention refers to a device for embossing and/or satinizing flat materials, more particularly packaging foils, and to packaging foils produced with the device. A device of this kind is e.g. known from EP-B-925 911 to the applicant of the present invention. The device for satinizing a foil disclosed in this reference, which is based on the knowledge from earlier patents of the same applicant, comprises two embossing rolls that are arranged in a mutually displaceable manner such that a self-stabilizing effect is obtained when the teeth of the embossing rolls interpenetrate, thereby providing a high processing speed, on one hand, and a high precision, on the other hand. First of all, this allows a uniform satinizing, and with a corresponding machining of the teeth, a highly precise embossing of foils is provided.

EP-A2-0 194 042 discloses an embossed object on the substrate of which first and second optically non-diffractive relief elements defining first and second patterns are embossed, the patterns having a uniform reflectivity and their appearance varying with the viewing angle. The specification discloses line patterns only, and no satinizing is intended.

This advanced prior art with regard to the quality of the embossing and satinizing has led to the desire and the need and thus to the object of the present invention to provide an embossing device that allows to emboss the flat material with signs including optical effects depending on the viewing position and/or the light source, thereby also allowing to produce security features that are very difficult to copy. In addition to the sign, the packaging foil produced in the device should also be satinized.

SUMMARY OF INVENTION

The first object is attained with a device for satinizing and simultaneously embossing flat materials, comprising at least two embossing rolls, wherein one roll is connected to a driving system, said rolls being capable of being driven individually or in common and being adapted to be resiliently applied against each other, and the pyramidal or conical teeth of the rolls having flattened tips, characterized in that the teeth (T2) of at least one roll are shaped such as to produce embossed signs (L) in the corresponding locations of the passing flat material whose appearance changes according to the viewing angle of the observer (O) and/or the kind and/or the position of the lighting source (LS). A packaging foil embossed in a device of this kind may be defined by a metallized and/or reflecting packaging foil produced with a device just described, characterised in that it is satinized and provided on the satinized background with a sign (L) whose intensity changes according to the viewing angle (O) and/or the kind and/or the position of the lighting source.

BRIEF DESCRIPTION OF THE DRAWINGS

The invention will be explained in more detail hereinafter with reference to drawings of exemplary embodiments.

DESCRIPTION OF EXEMPLARY EMBODIMENTS

As to the fundamental structure of an embossing device, reference will be made to U.S. Pat. No. 5,007,271 to the applicant of the present invention. A foil band is passed between two toothed embossing rolls of which one is fixedly supported and driven while the other one is freely rotatably journalled on an axle and is capable of being resiliently pressed against the driven roll with an adjustable pressure by spring force or by pneumatic or other means.

Figure 1:
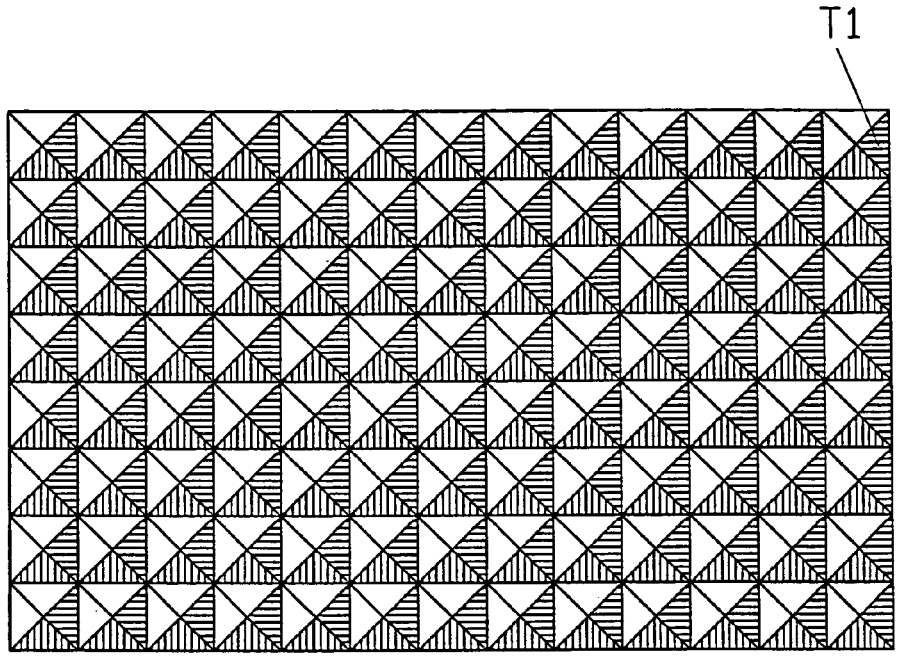
FIG. 1 schematically shows a developed view of a conventional toothing of a satinizing roll.

In the device of the prior art, e.g. according to EP-B-925 911, both embossing rolls are provided with a superficial toothing of the same kind which is schematically shown in FIG. 1 in a developed view, and which comprises pyramidal teeth that are arranged in rows extending in the circumferential direction, i.e. in the direction of rotation indicated by the arrow, and perpendicularly thereto in the axial direction. According to FIG. 2, the tips of the teeth are flattened, i.e. shortened in practice by at least 2%, preferably by up to 25% of the theoretical geometrical tooth height. Furthermore, the edges of the pyramidal teeth resp. of the truncated pyramids are preferably chamfered. Instead of pyramidal teeth, it is also possible to use conical resp. frustoconical teeth.

In the preferred embodiment according to the above-mentioned reference, the rolls have a relative axial play of at least half the tooth pitch, preferably of three quarters of the tooth pitch, thereby allowing a mutual displacement of the rolls into a stable position.

While these embossing rolls of the prior art are provided with toothings of the same kind, it has been found that providing at least one roll with teeth of a different design, more particularly with respect to the tooth height and the tooth surface, allows producing embossed structures that may be defined as shadow patterns, where the intensity of the signs embossed within the satinized background varies according to the viewing angle of the observer and/or the direction and the kind of the lighting, thereby producing a shadow-like effect.

It is obvious that the geometrical center lines of the teeth, i.e. the grid, must be equidistant as a synchronization or self-synchronization is otherwise impossible. For technical reasons, it is furthermore advantageous to use teeth having the same horizontal projection, so that the variations relate either to the tooth height or to the design of the tooth flanks and/or edges and/or to a surface design such as a roughened, corrugated, or patterned surface, or a combination of two or of all parameters.

Figure 2:
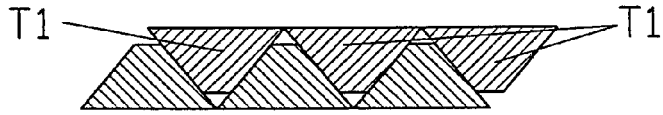
FIG. 2 shows the stable position of engagement of conventional toothings of two satinizing rolls.
Figure 3:
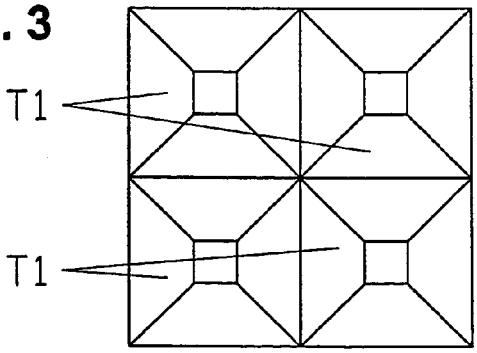
FIG. 3 shows a conventional toothing on an enlarged scale.
Figure 4:
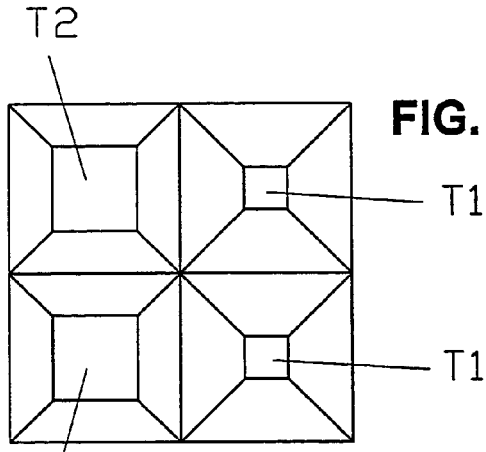
FIG. 4 shows a toothing of the invention on the same scale as in FIG. 3.
Figure 5:
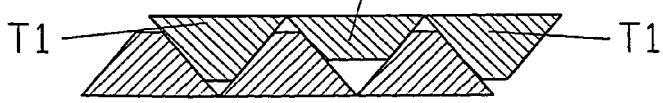
FIG. 5 shows the stable position of engagement of the toothings of two satinizing rolls of the invention.

In the embodiment of FIG. 4, two teeth T1 are shown which are designed as the teeth according to FIGS. 1 to 3, and all of which have the same geometrical dimensions and produce a normal satinizing, as well as the teeth T2 on the left of FIG. 4, having e.g. a smaller tooth height, or alternatively different tooth flanks or surfaces. In some embodiments, the surface of the flattened portion of the other teeth is structured. In some embodiments, the other teeth (T2)

have differently shaped flanks or edges than the remaining teeth (T1). In the known embossing process, the teeth are completely eroded in the locations where the signs are to be produced.

In principle, the teeth T2 of different height, shape, or surface than teeth T1 may be arranged in any way, but the teeth T2 are advantageously arranged in a specific manner to produce patterns, letters, or other signs. FIG. 4 shows a simple arrangement forming e.g. the letter L. By arranging the teeth T2 in such a configuration, the letter is produced such that according to the viewing angle, a higher or lower contrast, resp. a higher or lower intensity is obtained; while it is assumed here that the lighting source is constant and stationary. Alternatively, the position and/or the wavelength of the lighting source may be varied while the observer always sees the sign from the same angle, or both the viewing angle and the light source may change. The result always remains the same, i.e. the appearance of the sign changes as one or both or all parameters vary.

Figure 6:
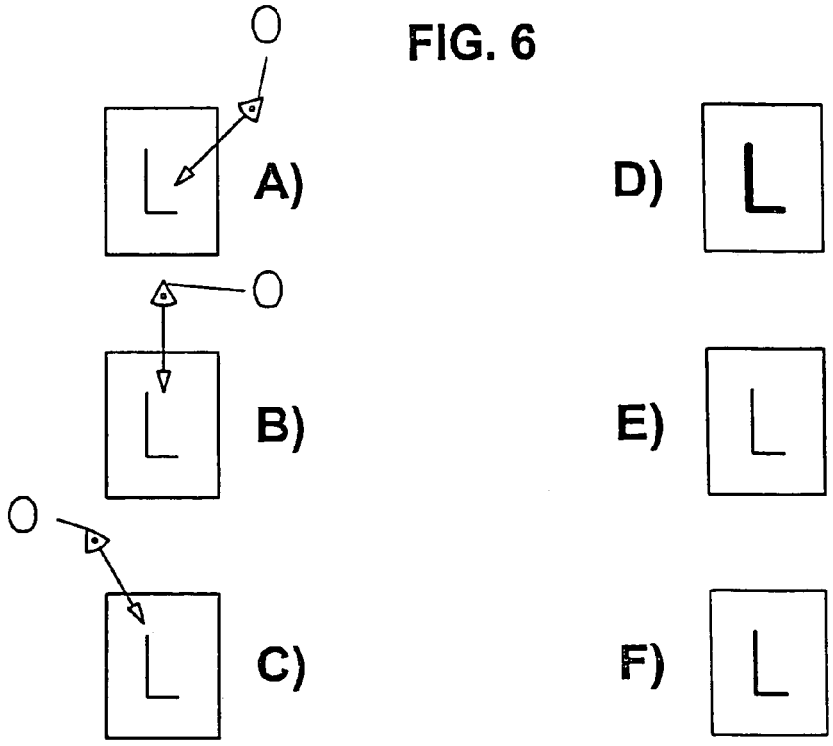
FIGS. 6A–6F show the effect of a special embossing of the invention by way of an exemplary sign.

In FIGS. 6A, B, C, the respective observer is designated by an "O", the arrow indicating the viewing angle and the observer looking at a satinized foil with a shadow-embossed L from the top right, from the top and from the left, respectively, in positions 6A, B, C, and the contrast being high according to 6D, low according to 6E and medium high according to 6F, while a constant lighting is assumed.

Figure 7:
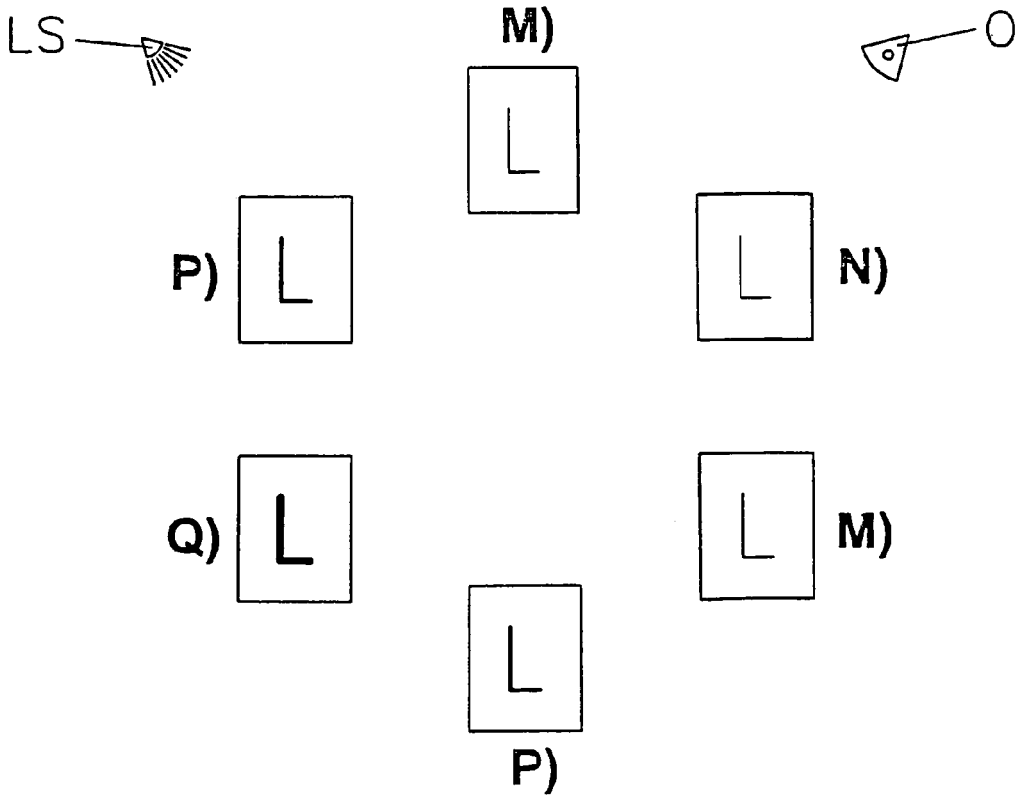
FIG. 7 shows a possible disposition of several embossed signs.

FIG. 7 shows by way of example how it is possible to arrange groups of signs in order to combine different features or to produce certain codes. FIG. 7 illustrates that from a given viewing angle and under an illumination LS from a given location, depending on its position, the letter "L" appears faint at the top and on the right (M), very faint at the top right (N), medium strong at the bottom and on the left (P), and very strong at the bottom left (Q). As explained with reference to FIG. 6, the appearance of a sign changes as the viewing angle is varied, but also when the position, the illuminating mode, the brightness and the wavelength of the lighting source changes.

For the sake of simplicity, the same letter "L" has also been used in FIG. 7, while it is understood that letters or numbers of any kind may be concerned. This procedure is very useful in the production of codes resp. security features, and it is also possible to use a sequence of numbers that changes.

Thus, these special effects on packaging bands, foils or boxes can be produced in a very large variety, and it is possible to produce them for any viewing angle and for a variation of the viewing angle and/or of the lighting source. These effects, depending on the viewing angle resp. on the lighting conditions or on the wavelength of the light, are a result of the design of the teeth. Thus, for example, variations in the arrangement resp. in the design of the tooth flanks and/or edges also produce effects depending on the viewing angle and the lighting conditions because the dimensions of the teeth are very small, so that variations in the shape or in the design of the surfaces of the teeth producing the signs will result in optical effects depending on the angular position due to different light reflections or diffractions on the embossed object.

Such signs may be provided on packaging materials for tobacco products, cigarettes, foods, chocolates, drugs or the like. Such packaging bands or foils are preponderantly composed of aluminum or preponderantly of easily foldable paper. Lately, for environmental reasons, the embossed materials have been modified in the sense that the embossed media such as metallized paper, amongst others, are highly fibrous while the thickness of the metallized layer has simultaneously been reduced, thereby substantially deteriorating the favorable folding behavior. This may also be the case if a synthetic substrate is used instead of paper, or if the metallized layer is replaced by a synthetic coating having similar properties. Today, multilayered foils with a paper substrate and a metal layer, and foils provided with a thin vapor-deposited metallic layer are distinguished.

So far, the embossed structures with the mentioned optical effects have been discussed in the context of a roll system including two embossing rolls. In order to take into account the above-described developments of the embossed materials, resp. their reduced metallization—thereby enlarging both the field of applications and the manufacturing possibilities of such embossed structures with optical effects—a device for the treatment of flat materials as described in previously unpublished International Patent Application PCT/00/023,299 is advantageously used. In this device, the second embossing roll is followed by at least another embossing roll cooperating with the first or preceding embossing roll in order to produce substantially the same pattern in a subsequent embossing. This device may be modified such that instead of embossing the same pattern, the above-mentioned embossed structure with optical effects is produced in the subsequent embossing process by providing the additional roll, or one or several ones of the at least three embossing rolls, with teeth having different geometrical dimensions and/or differently designed surfaces.

It is also mentioned in the cited reference that the embossing rolls may be synchronized to each other by synchronizing means. Likewise, the present invention is not limited to embossing rolls of which one is journalled such as to be capable of an excursion in the longitudinal direction of the axis and/or in the direction of the contact pressure and/or in the passing direction of the embossed material in order to provide a self-synchronization. Furthermore, a respective tooth of one roll need not necessarily engage between four adjacent teeth of the other roll, as in FIG. 3, which illustrates the case of the so-called pinup-pinup configuration where the teeth of all rolls face outwards. On the contrary, in the embossing procedures of the invention, it may by useful to positively synchronize the embossing rolls, thereby also allowing to use a so-called pinup-pindown configuration where the teeth of one roll poin out outwards and the teeth of a cooperating roll point out inwards.

In some embodiments, to be precise, the second embossing roll is followed by at least another embossing roll cooperating with the first or preceding embossing roll in order to produce the signs of changing appearance in a subsequent embossing process, the teeth (T2) being provided on one or on several ones of the rolls.

The above devices allow to produce not only changing optical effects through embossing, but also security features that are highly forgery-proof and generally visible by the eye. Such security features may e.g. be used for expensive drugs, electronic goods or in the tobacco industry.

The invention claimed is:

1. Device for satinizing and simultaneously embossing packaging foils, comprising at least two embossing rolls, wherein one roll is connected to a driving system, said rolls being adapted to be driven individually or in common and being adapted to be resiliently applied against each other, wherein the rolls have pyramidal or conical teeth having flattened tips, wherein some of the teeth are adapted to produce satining and other of the teeth have at least one of a geometric form and surface different from that of the teeth adapted to produce satining so that, when the packaging foil is passed through the device, embossed signs are produced in corresponding locations of the packaging foil, the produced embossed signs having an appearance that changes according to at least one of a viewing angle of the observer, a kind of lighting source and the position of the lighting source.

2. Device according to claim 1, wherein the teeth having at least one of a geometric form and surface different from that of the teeth adapted to produce satining have a smaller height than the remaining teeth.

3. Device according to claim 2, wherein the teeth having at least one of a geometric form and surface different from that of the teeth adapted to produce satining have differently shaped flanks or edges than the remaining teeth.

4. Device according to claim 2 wherein the surface of the flattened portion of the teeth having at least one of a geometric form and surface different from that of the teeth adapted to produce satining is structured.

5. Device according to claim 1, wherein the device comprises two embossing rolls.

6. Device according to claim 4, wherein a second embossing roll is followed by at least another embossing roll cooperating with a first or preceding embossing roll in order to produce the signs of changing appearance in a subsequent embossing process, the teeth having at least one of a geometric form and surface different from that of the teeth adapted to produce satining being provided on one or on several ones of the rolls.

7. Device according to claim 1, wherein the embossing rolls are mutually synchronized by synchronizing means.

8. Device according to claim 1, comprising at least one undriven roll, wherein at least one of the undriven rolls is jounalled as to be capable of an excursion in at least one of a longitudinal direction of the axis, a direction of the contact pressure and a passing direction of the embossed material.

9. At lease one of a metallized and reflecting packaging foil produced with a device according to claim 1, wherein at least one metallized and reflecting package foil is satinized and provided on the satinized background with a sign whose intensity changes according to at least one of the viewing angle the kind of lighting source and the position of the lighting source.

10. Foil according to claim 9, comprising at least one group of signs having the same appearance individually, in pairs or in groups.

11. Device according to claim 1, wherein the packaging foil is cigarette packaging material.

12. Device according to claim 9, wherein the packaging foil is cigarette packaging material.

13. A method of satinizing and simultaneously embossing packaging foils, comprising:

obtaining a packaging foil;

passing the packaging foil between two embossing rolls, wherein the rolls have pyramidal or conical teeth having flattened tips, wherein some of the teeth are adapted to produce satining and other of the teeth have at least one of a geometric form and surface different from that of the teeth adapted to produce satining to produce embossed signs in corresponding locations of the packaging foil to obtain produced embossed signs having an appearance that changes according to at least one of a viewing angle of the observer, a kind of lighting source and the position of the lighting source.

* * * * *